US007592550B2

(12) United States Patent
Stutzman et al.

(10) Patent No.: US 7,592,550 B2
(45) **Date of Patent: *Sep. 22, 2009**

(54) CABLE WITH TWISTED PAIR CENTERING ARRANGEMENT

(75) Inventors: Spring Stutzman, Sidney, NE (US); Dave Wiekhorst, Potter, NE (US); Fred Johnston, Dalton, NE (US); Scott Juengst, Sidney, NE (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/891,655

(22) Filed: Aug. 10, 2007

(65) Prior Publication Data

US 2008/0115958 A1 May 22, 2008

Related U.S. Application Data

(63) Continuation of application No. 11/318,350, filed on Dec. 22, 2005, now Pat. No. 7,271,342.

(51) Int. Cl.
*H01B 7/00* (2006.01)

(52) U.S. Cl. ..... 174/113 C

(58) Field of Classification Search ..... 174/113 R, 174/113 C, 131 A

See application file for complete search history.

(56) References Cited

U.S. PATENT DOCUMENTS

| | | | |
|---|---|---|---|
| 3,819,443 | A | 6/1974 | Simons et al. |
| 5,132,488 | A | 7/1992 | Tessier et al. |
| 5,789,711 | A | 8/1998 | Gaeris et al. |
| 5,902,962 | A | 5/1999 | Gazdzinski |
| 5,952,615 | A | 9/1999 | Prudhon |
| 5,969,295 | A | 10/1999 | Boucino et al. |
| 6,074,503 | A | 6/2000 | Clark et al. |
| 6,091,025 | A | 7/2000 | Cotter et al. |
| 6,150,612 | A | 11/2000 | Grandy et al. |
| 6,222,130 | B1 | 4/2001 | Gareis et al. |
| 6,248,954 | B1 | 6/2001 | Clark et al. |
| 6,288,340 | B1 | 9/2001 | Arnould |
| 6,297,454 | B1 | 10/2001 | Gareis |
| 6,365,836 | B1 | 4/2002 | Blouin et al. |
| 6,596,944 | B1 | 7/2003 | Clark et al. |
| 6,624,359 | B2 | 9/2003 | Bahlmann et al. |
| 6,639,152 | B2 | 10/2003 | Glew et al. |

(Continued)

FOREIGN PATENT DOCUMENTS

| | | |
|---|---|---|
| EP | 1 215 688 | 6/2002 |

(Continued)

OTHER PUBLICATIONS

Krone Product Data Sheet, "Bulk Patch Cord Cable", Issue Date: Jan. 16, 2001, 1 page.

*Primary Examiner*—Chau N Nguyen
(74) *Attorney, Agent, or Firm*—Merchant & Gould P.C.

(57) ABSTRACT

A multi-twisted pair cable including a plurality of twisted pairs positioned within pockets of a filler. The filler including shaped elements having retaining members for retaining the twisted conductor pairs of the plurality within the pockets of the filler. At least one of the shaped elements of the filler having an end piece that creates a helical ridge in the jacket of the multi-twisted pair cable.

17 Claims, 7 Drawing Sheets

U.S. PATENT DOCUMENTS

| | | | | |
|---|---|---|---|---|
| 6,787,697 | B2 | 9/2004 | Stipes et al. | |
| 6,800,811 | B1 | 10/2004 | Boucino | |
| 6,812,408 | B2 | 11/2004 | Clark et al. | |
| 7,271,342 | B2 * | 9/2007 | Stutzman et al. | 174/113 C |
| 2004/0055781 | A1 | 3/2004 | Cornibert et al. | |
| 2004/0149483 | A1 | 8/2004 | Glew | |
| 2005/0023028 | A1 * | 2/2005 | Clark | 174/113 R |
| 2005/0092515 | A1 | 5/2005 | Kenny et al. | |
| 2005/0103518 | A1 | 5/2005 | Glew | |
| 2005/0199415 | A1 | 9/2005 | Glew | |
| 2005/0269125 | A1 | 12/2005 | Clark | |
| 2006/0237221 | A1 | 10/2006 | Glew | |
| 2006/0243477 | A1 | 11/2006 | Jean et al. | |

FOREIGN PATENT DOCUMENTS

| | | |
|---|---|---|
| WO | WO 01/54142 | 7/2001 |

* cited by examiner

CABLE WITH TWISTED PAIR CENTERING ARRANGEMENT

CROSS-REFERENCE TO RELATED APPLICATIONS

This application is a continuation of U.S. application Ser. No. 11/318,350, filed Dec. 22, 2005; which application is incorporated herein by reference.

TECHNICAL FIELD

The present disclosure relates generally to devices for use in the telecommunications industry, and various methods associated with such devices. More particularly, this disclosure relates to a telecommunications cable having twisted conductor pairs.

BACKGROUND

A wide variety of cable arrangements having twisted conductor pairs are utilized in the telecommunication industry. Some cable arrangements include a number of twisted conductor pairs separated by one or more filler components.

In general, improvement has been sought with respect to existing cable arrangements, generally to improve the structural reliability of the assembly of such cable arrangements, and improve signal transmission performance.

SUMMARY

The present disclosure relates to a multi-twisted pair cable arrangement. The cable arrangement generally includes a plurality of twisted conductor pairs, a filler, and a jacket that covers the twisted conductor pairs and filler. The filler of the cable includes shaped elements located at the ends of extensions. Each of the shaped elements includes a retaining member for retaining the twisted conductor pairs in relation to the filler. In one aspect, the filler includes first and second shaped elements located at the ends of the extensions. In another aspect, at least one of the shaped elements includes a projecting end piece located a distance farther from the center of the filler than the other shaped elements. The projecting end piece creates a helical ridge in the jacket of the cable.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

I. Multi-Pair Cable, Generally

Figure 1:
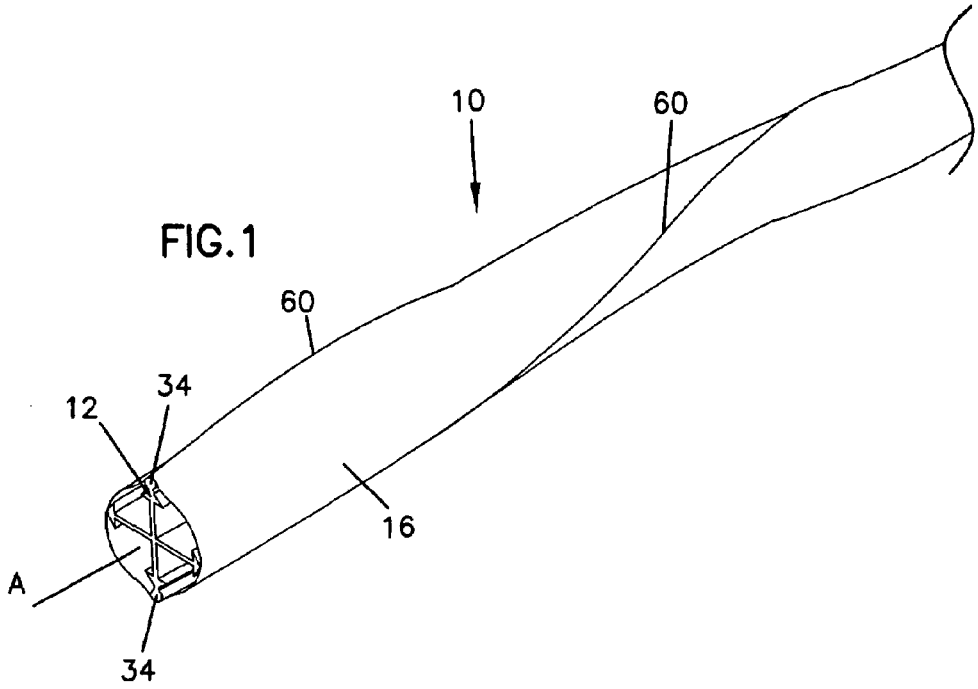
FIG. 1 is a perspective view of one embodiment of multi-pair cable arrangement, according to the principles of the present disclosure, shown without twisted pairs.

FIG. 1 illustrates a multi-pair cable 10 including one embodiment of a filler 12 having features that are examples of how inventive aspects in accordance with the principles of the present disclosure may be practiced. Preferred features of the cable 10 and disclosed filler embodiments are adapted to improve the structural reliability of the assembly of such cable arrangements, and to improve the signal transmission performance of the cable arrangements.

Figure 4:
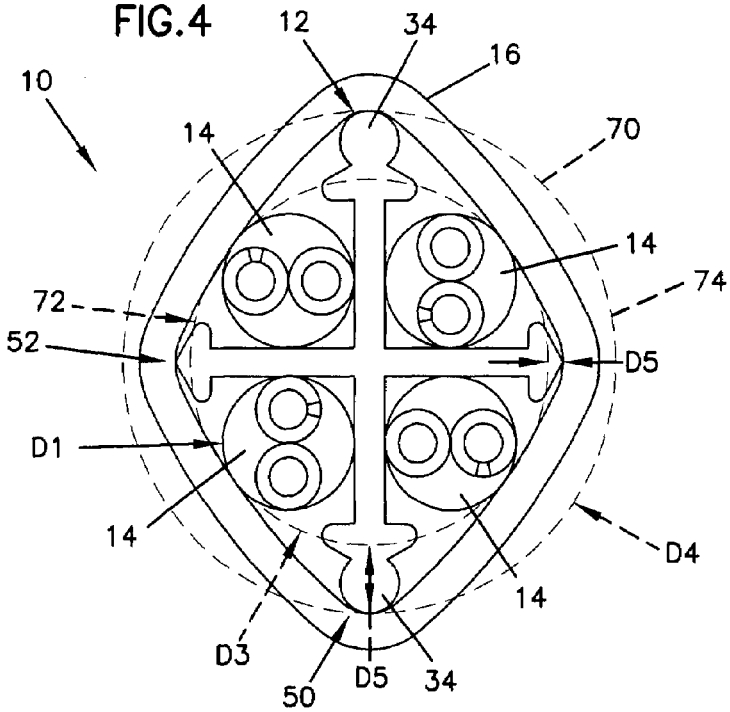
FIG. 4 is a cross-sectional view of the multi-pair cable of FIG. 1, shown with twisted pairs.

Referring to FIGS. 1 and 4, in general, the filler 12 of the multi-pair cable 10 of the present disclosure is constructed to separate and retain a plurality of twisted conductor pairs 14 (FIG. 4). The twisted conductor pairs 14 each include two insulated conductors twisted about one another along a longitudinal axis. In the illustrated embodiment, the filler 12 of the multi-pair cable 10 separates and retains four twisted conductor pairs 14. The multi-pair cable 10 includes a jacket 16 that covers or surrounds the twisted pairs 14 and the filler 12.

Figure 2:
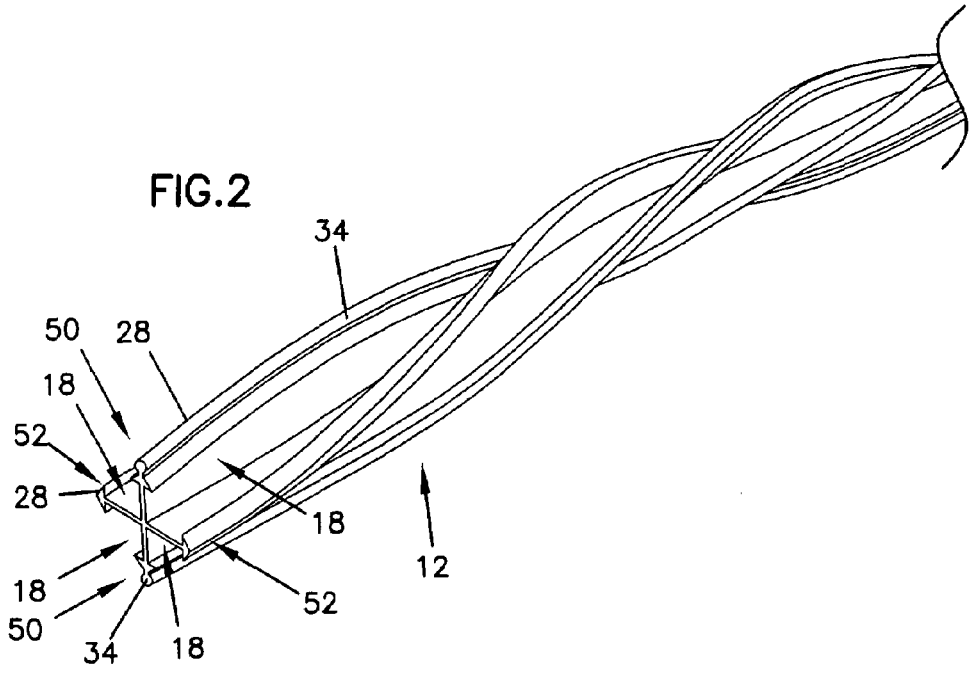
FIG. 2 is a perspective view of a first embodiment of a filler of the multi-pair cable arrangement of FIG. 1.

Referring now to FIG. 2, the filler 12 defines a number of pockets 18. Each of the twisted conductor pairs 14 is positioned within one of the number of pockets 18 (see also FIGS. 3 and 4). In the illustrated embodiment, the filler 12 has four pockets 18 that receive the four twisted conductor pairs 14.

Figure 3:
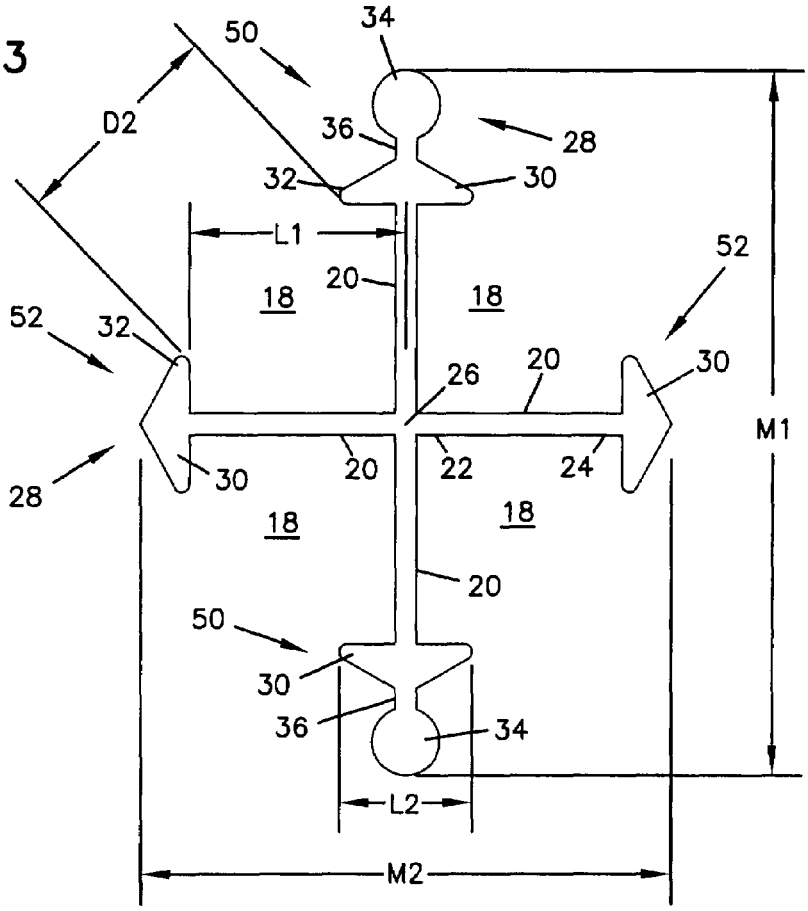
FIG. 3 is a cross-sectional view of the shape of the filler of FIG. 2.

FIG. 3 is a cross-sectional area of a die used in the manufacture of the filler 12 shown in FIG. 2. The cross-sectional area is representative of the cross-sectional shape of the filler 12 produced from the die, and is hereinafter used to describe the cross-sectional shape of the filler 12. FIGS. 5-11 likewise are cross-sectional views of the area of a die used in the manufacture of the respective filler, and are also used to described the cross-sectional shape of the respective filler.

Referring now to FIG. 3, the pockets 18 of the filler 12 are defined by four radial extensions (e.g., spokes or legs) 20. The radial extensions 20 separate each of the twisted conductor pairs 14 from the other twisted conductor pairs. The radial extensions 20 of the filler 12 each have a first end 22 and a second end 24. The first ends 22 of the radial extensions 20 are joined and define a center 26 of the filler 12. The center 26 of the filler 12 generally defines the central longitudinal axis A (FIG. 1) of the cable 10. The second ends 24 of the radial extension 20 are free ends.

As shown in FIG. 3, each of the radial extensions 20 of the filler 12 has a length L1 that extends from the first end 22 or center 26 to the free end 24. The length L1 of each of the radial extensions 20 is preferably equal to or greater than a diameter D1 (FIG. 4) of each twisted conductor pairs 14. In the illustrated embodiment, the length L1 of the extensions 20 is typically between about 0.075 inches and 0.115 inches; more specifically between about 0.095 and 0.098 inches.

The radial extensions 20 have a spoke-like configuration. What is meant by spoke-like is that the extensions have a cross-sectional shape that is straight or linear along a substantial majority of the extension construction. The straight or linear spoke-like configuration is in contrast to constructions having non-linear cross-sectional shapes. The four spokes or radial extensions 20 are oriented generally perpendicular to one another to define a "plus" or "cross" shape (+). Other numbers of spokes can be used to define other shaped fillers 12.

In the illustrate embodiment of FIG. 3, the filler 12 includes shaped elements 28 located at the free ends 24 of the radial extension 20. The four extensions 20 and shaped elements 28 are arranged such that a first two of the four extensions 20 and elements 28 define a major dimension M1 of the filler 12, and a second two of the four extensions 20 and elements 28 defines a minor dimension M2 transverse to the major dimension M1. The major dimension M1 of the filler 12 in this embodiment is greater than the minor dimension M2 of the filler. In particular, the major dimension M1 is between about 0.280 inches and 0.320 inches; more preferably about 0.300 inches. The minor dimension M2 is between about 0.220 inches and 0.260 inches; more preferably about 0.240 inches.

Still referring to FIG. 3, the shaped elements 28 of the filler 12 include first shaped elements 50 and second shaped elements 52. What is meant by "shaped element" is an element that is non-uniform in shape with that of the radial extension 20. The first shaped elements 50 are located at the free ends 24 of the radial extensions 20 that define the major dimension M1 of the filler 12. The second shaped elements 52 are located at the free ends 24 of the radial extensions 20 that define the minor dimension M2 of the filler 12.

Each of the first and second shaped elements 50, 52 shown in FIG. 3 includes a retaining member 30. The retaining members 30 are located at the free ends 24 of the respective radial extensions 20. The retaining members 30 are arranged and configured to retain the twisted conductor pairs 14 within the pockets 18 of the filler 12. In particular, each of the retaining members 30 has a major length L2. The retaining members 30 are oriented such that the major length L2 of the retaining member 30 is transverse to the length L1 of the respective radial extension 20. The major length L2 is provided so that adjacent end portions 32 of adjacent retaining members 30 contain or hold the twisted conductor pairs 14 within the pockets 18 of the filler.

That is, a distance D2 between adjacent end portions 32 of adjacent retaining members 30 is preferably equal to or less than the diameter D1 of the twisted conductor pair 14. (Although, as will be described in greater detail hereinafter, portions along the length of the filler 12 may have a distance greater than the diameter D1 of the twisted conductor pair when the cable is fully assembled.) The retaining members 30 do not fully enclose the twisted conductor pair 14 when the pair is positioned within the pocket 18. Rather, the retaining members 30 function to retain the twisted conductor pair 14 within the pocket 18 of the filler 12 by contacting the pair in a captive manner, as opposed to enclosing or substantially surrounding the twisted conductor pair 14.

In particular, the opening or distance D2 is somewhat comparable to the diameter D1 of the twisted conductor pairs 14. The opening or distance D2, with the twisted conductor pair 14 positioned in the pocket 18 and retained, is between about 75 and 125 percent of the diameter D1 of the pair 14. The relatively large opening or distance D2 accommodates the zip-fit feature of the filler described hereinafter. As will also be described hereinafter, the filler 12 deforms during assembly so that the retaining members 30 more fully engage or contact the twisted conductor pairs 14 to retain the pairs within the pockets 18 of the filler 12.

To achieve the preferred retaining feature of the disclosed filler 12, one or both of the retaining members 30 and the radial extensions 20 is preferably made of a material that flexes to permit placement of the twisted conductor pairs 14 within the pockets 18, and to permit bending and distortion of the filler 12 during assembly. In one embodiment, the filler 12, i.e., the radial extensions 20 and the retaining members 30, are made of a non-conductive material, such as polyethylene. Other materials can be used to manufacture the filler 12 in accordance with the principles disclosed.

Preferably, the retaining members 30 of the filler 12 are constructed such that the twisted conductor pairs 14 snap-fit or zip within the pockets 18 of the filler 12. That is, the flexible construction of the filler 12 permits the twisted conductor pairs 14 to be placed into the pockets 18 by pressing or zipping the twisted conductor pairs 14 along the lengths of the pairs and filler 12. The zip-fit construction of the filler 12 makes assembly and manufacture of the multi-pair cable 10 easier than conventional arrangements, as the twisted conductor pairs 14 are held in place by the zip-fit during the remainder of the assembly of the multi-pair cable 10.

Still referring to FIG. 3, the illustrated retaining members 30 of the shaped elements 28 have an arrowhead shape, i.e., a triangular shape. The triangular retaining members 30 are oriented such that the apex opposite the longest side of the triangular retaining member 30 points outward from the center 26 of the filler 12. As will be described in greater detail hereinafter, the retaining members can have other shapes and configurations.

In the illustrated embodiment of FIG. 3, the second shaped elements 52 of the filler 12 are simply the triangular retaining members 30 located at the free ends 24 of the extension 20. The first shaped elements 50 however further include an end piece 34 located adjacent to the triangular retaining element 30. The end pieces 34 are interconnected to the retaining elements 30 by a neck 36. The neck 36 and the end piece 34 of the first shaped elements 50 provide the major dimension M1 that is greater than the minor dimension M2 provided by the second shaped elements 52 of the filler.

Referring back to FIGS. 1 and 2, the end pieces 34 of the first shape elements 50 project radially outward a distance farther from the center 26 of the filler 12 than the second shaped elements 52. The projecting end pieces 34 create helical ridges 60 in the jacket 16 of the multi-pair cable 10. The helical ridges 60 function to separate two multi-pair cables 10 from one another by providing air gaps between adjacent cables. The air gaps aid in reducing crosstalk, which can distort signals carried by the cables. In the illustrated embodiment, the end pieces 34 of the first shaped elements 50 have a circular cross-section. As will be described in greater detail hereinafter, the end pieces can have other shapes and configurations.

II. Method of Manufacturing, Generally

The following description generally relates to the manufacture of the multi-pair cable. It is to be understood that although the following method of manufacture is described with respect to the embodiment shown in FIG. 3, the method can be used in the same manner for the manufacture of cables incorporating the other filler embodiments of FIG. 5-11 described hereinafter.

In the manufacture of the disclosed multi-pair cable 10, the twisted conductor pairs 14 are positioned within the pockets 18 of the filler 12. Preferably, the twisted conductor pairs 14 are pressed or zip-fit within the pocket 18 of the filler 12 and retained by the retaining member 30.

The retaining members 30 are constructed to retain the twisted conductor pairs 14 at or adjacent to the center 26 of the filler 12. As shown in FIG. 4, the retaining members 30 retain the twisted conductor pairs 14 within a boundary 70 (represented by dashed line). The boundary 70 defines an outer diameter D3 of a twisted pairs core 72, which is defined by the twisted conductor pairs 14.

Each of the twisted conductor pairs 14 of the core 72 preferably has an individual conductor twist rate that is different from the twist rates of the other twisted conductor pairs of the core. After the twisted conductor pairs 14 are zip-fit within the pockets 18 of the filler 12, the filler, and accordingly the twisted conductor pairs 14, are twisted in unison about the central axis (i.e., axis A, FIG. 1) of the filler 12. As can be understood, because each of the twisted conductor pairs 14 is already twisted at a particular individual conductor twist rate, the individual conductor twist rates of the twisted conductor pairs 14 change when the filler 12 is twisted. Preferably, each of the twisted conductor pairs 14 has the same direction of twist (e.g. a right-hand twist or a left-hand twist) as the direction in which the filler 12 is twisted. By this, the individual conductor twist rates of the twisted conductor pairs 14 increase as the filler 12 is twisted.

After the filler 12 and the twisted conductor pairs 14 have been twisted, the jacket 16 is applied over the filler 12 and the twisted conductor pairs 14. As previously discussed, the end pieces 34 of the first shaped elements 50 of the filler create ridges 60 (FIG. 1) in the jacket 16. Because of the twisting of the filler 12, the ridges 60 formed in the jacket 16 are helical.

Referring back to FIG. 4, preferably, the shaped elements 50, 52 of the filler 12 are at least partially located outside the boundary 70 of the twisted pairs core 72. That is, the outermost shaped element (e.g., the end pieces 34 of the first shaped elements 50) of the filler 12 defines a shaped-element boundary 74 (represented by dashed line). The shaped-element boundary 74 is preferably radially greater than the boundary 70 of the core 72 to radially space the twisted pairs core 72 from the jacket 16. In the illustrated embodiment, the shaped-element boundary 74 of the filler 12 has a diameter D4 that is between about 0.275 inches and 0.325 inches. The diameter D3 of the boundary 70 of the core 72 is between about 0.165 inches and 0.215 inches.

While the illustrated diameter D4 of the shaped element boundary 74 is concentric with the diameter D3 of the core 72, the major dimension M1 (FIG. 3) and the minor dimension M2 of the filler 12 provide an elliptical-shaped cable 10. Accordingly, when the jacket 16 is provided around the filler 12 and twisted pairs core 72, the spacing or distance D5 between the diameter D3 of the core 72 and the jacket 16 varies (i.e., is non-concentric). For example, in the illustrated embodiment, the spacing or distance D5 between the twisted pairs core 72 and the jacket 16 at the second shaped elements 52 along the minor dimension M2 is at least about 0.022 inches; the distance D5 between the twisted pairs core 72 and the jacket 16 at first shaped elements 50 along the major dimension M1 is at least about 0.055 inches. Although the spacing D5 varies, spacing improves the overall signal transmission performance of the cable 10. In particular, the radial spacing of the twisted conductor pairs 14 of the core 72 from the jacket 16 reduces the occurrence of signal impedance or slowing. Signal impedance can be caused by contact between the twisted conductor pairs 14 and the jacket 16 due to the jacket having a less desirable dielectric constant than that of air, for example.

III. Alternative Filler Embodiments

Other embodiments having features that are examples of how inventive aspects in accordance with the principles of the present disclosure may be practiced are shown in FIG. 5-11. Many of the principles previously disclosed in reference to the first filler embodiment 12 of FIG. 3 apply similarly to the embodiments of FIGS. 5-11 hereinafter described. It is also to be understood that the previously described method of manufacturing a multi-pair cable, referring to the first filler embodiment 12 of FIG. 3, is applicable to each of the following alternative filler embodiments of FIGS. 5-11.

Referring generally to FIGS. 5-10, each of the embodiments of the fillers is constructed to separate and retain twisted conductor pairs (e.g., 14) of a multi-pair cable (e.g., 10). Each filler defines a number of pockets, for example, four pockets. Each of the twisted conductor pairs 14 is positionable with one of the number of pockets.

The pockets of each filler are defined by four radial extensions or spokes. The radial extensions of the filler each have a length L1 that extends from a first end or a center of the extension to a free end of the extension. The length L1 of each of the radial extensions is preferably greater than the diameter D1 (FIG. 4) of each twisted conductor pairs 14.

Each of the fillers shown in FIGS. 5-10 includes shaped elements located at the free ends of the radial extension. The four extensions and shaped elements are arranged such that a first two of the four extensions and elements define a major dimension M1 of each filler, and a second two of the four extensions and elements defines a minor dimension M2 transverse to the major dimension M1. The major dimension M1 of the fillers is greater than the minor dimension M2, which results in the cable 10 having an elliptical shape.

While many of the features of the filler embodiments of FIGS. 5-10 are similar, the filler embodiments of FIGS. 5-10 illustrate alternative embodiments of shaped elements that can be provided on the filler of a multi-twisted pairs cable 10.

Figure 5:
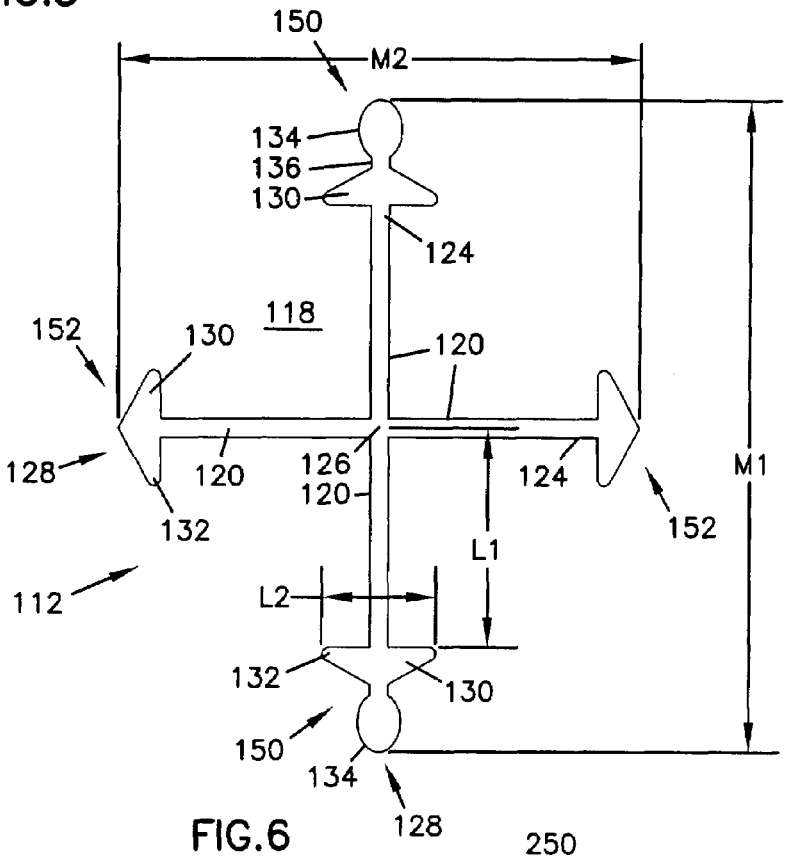
FIG. 5 is a cross-sectional view of a second embodiment of the shape of a filler for use in a multi-pair cable arrangement.

In particular, referring to FIG. 5, shaped elements 128 of a second filler 112 embodiment are illustrated. The shaped elements 128 include first shaped elements 150 and second shaped elements 152. The first shaped elements 150 are located at free ends 124 of radial extensions 120 that define a major dimension M1 of the filler 112. The second shaped elements 152 are located at the free ends 124 of radial extensions 120 that define a minor dimension M2 of the filler 112.

Each of the first and second shaped elements 150, 152 shown in FIG. 5 includes a retaining member 130. The retaining members 130 are located at the free ends 124 of the respective radial extensions 120. The retaining members 130 are arranged and configured to retain the twisted conductor pairs 14 within pockets 118 of the filler 112. In particular, each of the retaining members 130 is oriented such that a major length L2 of the retaining member 130 is transverse to a length L1 of the respective radial extension 120. The major length L2 is provided so that adjacent end portions 132 of adjacent retaining members 130 contain or hold the twisted conductor pair 14 within the pocket 118 of the filler, as previously described with respect to the embodiment of FIG. 3.

Still referring to FIG. 5, the illustrated retaining members 130 of the shaped elements 128 have an arrowhead shape, i.e., a triangular shape. In the illustrated embodiment, the second shaped elements 152 of the filler 112 are simply the triangular retaining members 130 located at the free ends 124 of the extension 120. The first shaped elements 150 however further include an end piece 134 located adjacent to the triangular retaining element 130.

The end pieces 134 are interconnected to the retaining elements 130 by a neck 136. The neck 136 and the end piece 134 of the first shaped elements 150 provide the major dimension M1 that is greater than the minor dimension M2 provided by the second shaped elements 152 of the filler. The end pieces 134 project radially outward a distance farther from a center 126 of the filler 112 than the second shaped elements 152 to create helical ridges 60 (FIG. 1) in the jacket 16 of the multi-pair cable 10, as previously described.

In the illustrated embodiment of FIG. 5, the end pieces 134 of the first shaped elements 150 have an oval shaped cross-section. The oval shaped cross-section provides an end piece with reduced material than that of the end piece 34 shown in FIG. 3. Reducing the amount of material needed to manufacture the filler 112 correspondingly reduces the weight of the filler, which is desirable in the industry.

Similar to the previous embodiment, the retaining members 130 of the filler 112 are constructed to retain the twisted conductor pairs 14 at or adjacent to the center 126 of the filler 112. That is, the retaining members 130 retain the twisted conductor pairs 114 within a boundary (e.g., 70 represented by dashed line in FIG. 4). The boundary defines an outer diameter (e.g., D3) of a twisted pairs core (e.g., 72) that is defined by the twisted conductor pairs 14.

As can be understood by reference to FIG. 4, preferably, the shaped elements 150, 152 of the filler 112 are at least partially located outside the boundary of the twisted pairs core. Similar to the embodiment shown in FIG. 4, the outermost shaped element, e.g., the end piece 134 of the first shaped element 150, of the filler 112 defines a shaped-element boundary (e.g., 74) that is greater than the boundary 70 of the twisted pairs core 72 to radially space the twisted pairs core from the jacket 16 of the cable 10.

Figure 6:
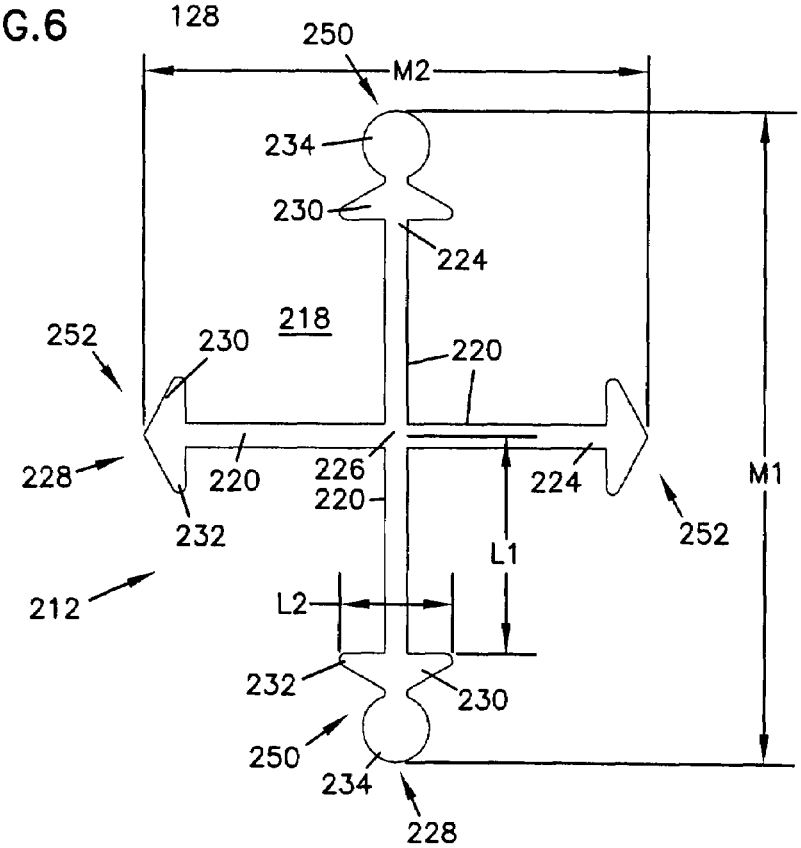
FIG. 6 is a cross-sectional view of a third embodiment of the shape of a filler for use in a multi-pair cable arrangement.

Referring now to FIG. 6, shaped elements 228 of a third filler 212 embodiment are illustrated. The shaped elements 228 include first shaped elements 250 and second shaped elements 252. The first shaped elements 250 are located at free ends 224 of radial extensions 220 that partially define a major dimension M1 of the filler 212. The second shaped elements 252 are located at free ends 224 of radial extensions 220 that partially define a minor dimension M2 of the filler 212.

Each of the first and second shaped elements 250, 252 shown in FIG. 6 includes a retaining member 230. The retaining members 230 are located at the free ends 224 of the respective radial extensions 220. The retaining members 230 are arranged and configured to retain the twisted conductor pairs 14 within pockets 218 of the filler 212. In particular, each of the retaining members 230 is oriented such that a major length L2 of the retaining member 230 is transverse to a length L1 of the respective radial extension 220. The major length L2 is provided so that adjacent end portions 232 of adjacent retaining members 230 contain or hold the twisted conductor pair 14 within the pocket 218 of the filler, as previously described with respect to the embodiment of FIG. 3.

Still referring to FIG. 6, the illustrated retaining members 230 of the shaped elements 228 have an arrowhead shape, i.e., a triangular shape. In the illustrated embodiment, the second shaped elements 252 of the filler 212 are simply the triangular retaining members 230 located at the free ends 224 of the extension 220. The first shaped elements 250 however further include an end piece 234 located adjacent to the triangular retaining element 230.

In contrast to the end pieces 34, 134 shown in the previous embodiments, the end pieces 234 of FIG. 6 are not interconnected to the retaining elements 230 by a neck. Instead, the end pieces 234 are located at the tip of the triangular retaining members 230. The end piece 234 of the first shaped elements 250 provide the major dimension M1 that is greater than the minor dimension M2 provided by the second shaped elements 252 of the filler. The end pieces 234 project radially outward a distance farther from a center 226 of the filler 212 than the second shaped elements 252 to create helical ridges 60 (FIG. 1) in the jacket 16 of the multi-pair cable 10, as previously described. In the illustrated embodiment of FIG. 6, the end pieces 234 of the first shaped elements 250 have a circular cross-section.

Similar to the previous embodiments, the retaining members 230 of the filler 212 are constructed to retain the twisted conductor pairs 14 at or adjacent to the center 226 of the filler 212. That is, the retaining members 230 retain the twisted conductor pairs 14 within a boundary (e.g., 70 represented by dashed line in FIG. 4). The boundary defines an outer diameter (e.g., D3) of a twisted pairs core (e.g. 72) that is defined by the twisted conductor pairs 14.

As can be understood by reference to FIG. 4, preferably, the shaped elements 250, 252 of the filler 212 are at least partially located outside the boundary of the twisted pairs core. Similar to the embodiment shown in FIG. 4, the outermost shaped element, e.g., the end piece 234 of the first shaped element 250, of the filler 212 defines a shaped-element boundary (e.g., 74) that is greater than the boundary 70 of the twisted pairs core 72 to radially space the twisted pairs core from the jacket 16 of the cable 10.

Figure 7:
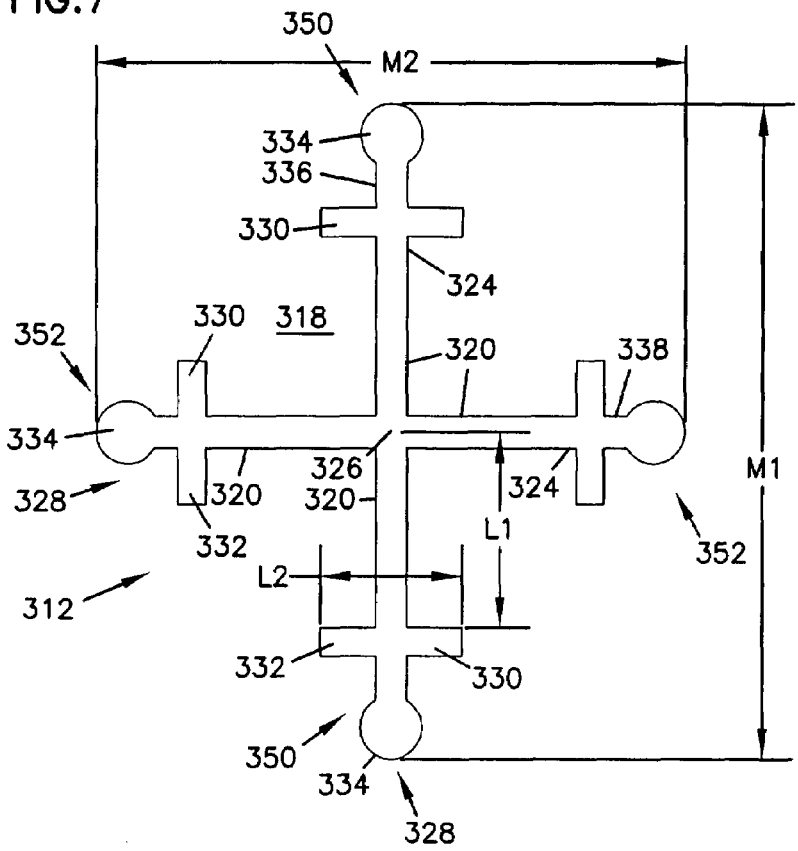
FIG. 7 is a cross-sectional view of a fourth embodiment of the shape of a filler for use in a multi-pair cable arrangement.

Referring now to FIG. 7, shaped elements 328 of a fourth filler 312 embodiment are illustrated. The shaped elements 328 include first shaped elements 350 and second shaped elements 352. The first shaped elements 350 are located at free ends 324 of radial extensions 320 that partially define a major dimension M1 of the filler 312. The second shaped elements 352 are located at free ends 324 of radial extensions 320 that partially define a minor dimension M2 of the filler 312.

Each of the first and second shaped elements 350, 352 shown in FIG. 7 includes a retaining member 330. The retaining members 330 are located at the free ends 324 of the respective radial extensions 320. The retaining members 330 are arranged and configured to retain the twisted conductor pairs 14 within pockets 318 of the filler 312. In particular, each of the retaining members 330 is oriented such that a major length L2 of the retaining member 330 is transverse to a length L1 of the respective radial extension 320. The major length L2 is provided so that adjacent end portions 332 of adjacent retaining members 330 contain or hold the twisted conductor pair 14 within the pocket 318 of the filler, as previously described with respect to the embodiment of FIG. 3.

Still referring to FIG. 7, the illustrated retaining members 330 of the shaped elements 328 have a rectangular shape. In the illustrated embodiment, the each of the first and second shaped elements 350, 352 of the filler 312 include an end piece 334 located adjacent to the rectangular retaining element 330.

The end pieces 334 are interconnected to the retaining elements 330 by necks 336, 338. Each of the necks 336 of the first shaped elements 350 is longer than the necks 338 of the second shaped elements 352. Accordingly, the necks 336 and the end pieces 334 of the first shaped elements 350 provide the major dimension M1 that is greater than the minor dimension M2 provided by the second shaped elements 352 of the filler. The end pieces 334 of the first shaped elements 350 project radially outward a distance farther from a center 326 of the filler 312 than the second shaped elements 352 to create helical ridges 60 (FIG. 1) in the jacket 16 of the multi-pair cable 10, as previously described. In the illustrated embodiment of FIG. 7, the end pieces 334 of the first and second shaped elements 350, 352 have a circular cross-section.

Similar to the previous embodiments, the retaining members 330 of the filler 312 are constructed to retain the twisted conductor pairs 14 at or adjacent to the center 326 of the filler 312. That is, the retaining members 330 retain the twisted conductor pairs 14 within a boundary (e.g., 70 represented by dashed line in FIG. 4). The boundary defines an outer diameter (e.g., D3) of a twisted pairs core (e.g. 72) that is defined by the twisted conductor pairs 14.

As can be understood by reference to FIG. 4, preferably, the shaped elements 350, 352 of the filler 312 are at least partially located outside the boundary of the twisted pairs core. Similar to the embodiment shown in FIG. 4, the outermost shaped element, e.g., the end piece 334 of the first shaped element 350, of the filler 312 defines a shaped-element boundary (e.g., 74) that is greater than the boundary 70 of the twisted pairs core 72 to radially space the twisted pairs core from the jacket 16 of the cable 10.

Figure 8:
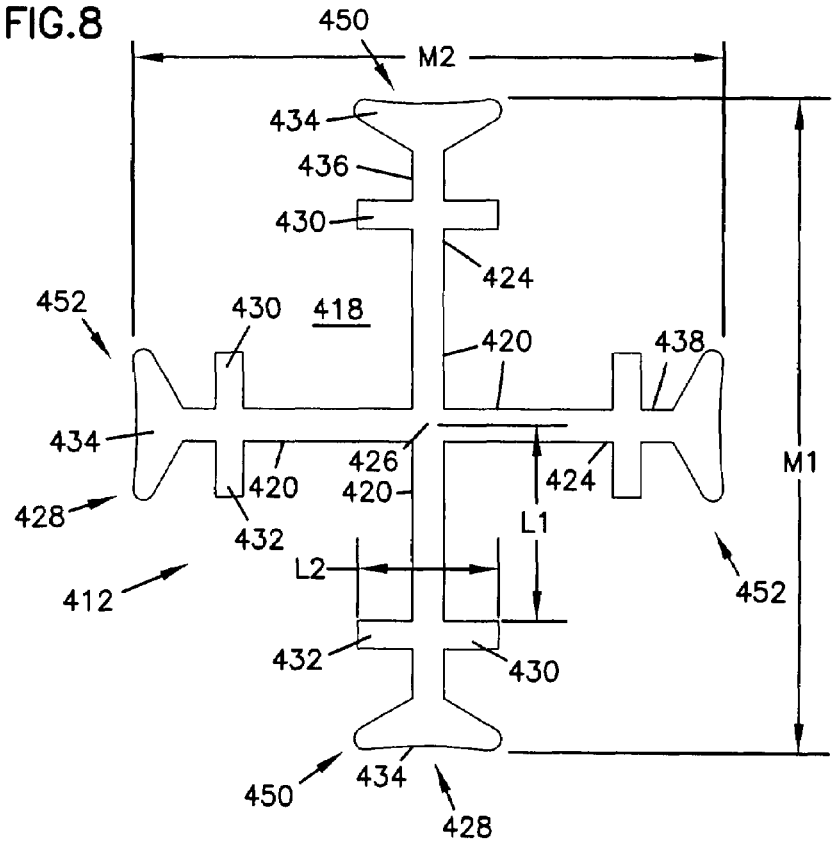
FIG. 8 is a cross-sectional view of a fifth embodiment of the shape of a filler for use in a multi-pair cable arrangement.

Referring now to FIG. 8, shaped elements 428 of a fifth filler 412 embodiment are illustrated. The shaped elements 428 include first shaped elements 450 and second shaped elements 452. The first shaped elements 450 are located at free ends 424 of radial extensions 420 that partially define a major dimension M1 of the filler 412. The second shaped elements 452 are located at free ends 424 of radial extensions 420 that partially define a minor dimension M2 of the filler 412.

Each of the first and second shaped elements 450, 452 shown in FIG. 8 includes a retaining member 430. The retaining members 430 are located at the free ends 424 of the respective radial extensions 420. The retaining members 430 are arranged and configured to retain the twisted conductor pairs 14 within pockets 418 of the filler 412. In particular, each of the retaining members 430 is oriented such that a major length L2 of the retaining member 430 is transverse to a length L1 of the respective radial extension 420. The major length L2 is provided so that adjacent end portions 432 of adjacent retaining members 430 contain or hold the twisted conductor pair 14 within the pocket 418 of the filler, as previously described with respect to the embodiment of FIG. 3.

Still referring to FIG. 8, the illustrated retaining members 430 of the shaped elements 428 have a rectangular shape. In the illustrated embodiment, the each of the first and second shaped elements 450, 452 of the filler 412 include an end piece 434 located adjacent to the rectangular retaining element 430.

The end pieces 434 are interconnected to the retaining elements 430 by necks 436, 438. Each of the necks 436 of the first shaped elements 450 is longer than the necks 438 of the second shaped elements 452. Accordingly, the necks 436 and the end pieces 434 of the first shaped elements 450 provide the major dimension M1 that is greater than the minor dimension M2 provided by the second shaped elements 452 of the filler. The end pieces 434 of the first shaped elements 450 project radially outward a distance farther from a center 426 of the filler 412 than the second shaped elements 452 to create helical ridges 60 (FIG. 1) in the jacket 16 of the multi-pair cable 10, as previously described.

In the illustrated embodiment of FIG. 8, the end pieces 434 of the first and second shaped elements 450, 452 are triangular in shape. The triangular end pieces are oriented such that the apex opposite the longest side of the triangular end pieces 434 points toward the center 426 of the filler 412.

Similar to the previous embodiments, the shaped elements 450, 452 of the filler 412 are at least partially located outside a boundary (e.g., 70 in FIG. 4) of the twisted pairs core (e.g., 72); and, the outermost shaped element, e.g., the end piece 434 of the first shaped element 450, of the filler 412 defines a shaped-element boundary (e.g., 74) that is greater than the boundary of the twisted pairs core to radially space the twisted pairs core from the jacket 16 of the cable 10.

Figure 9:
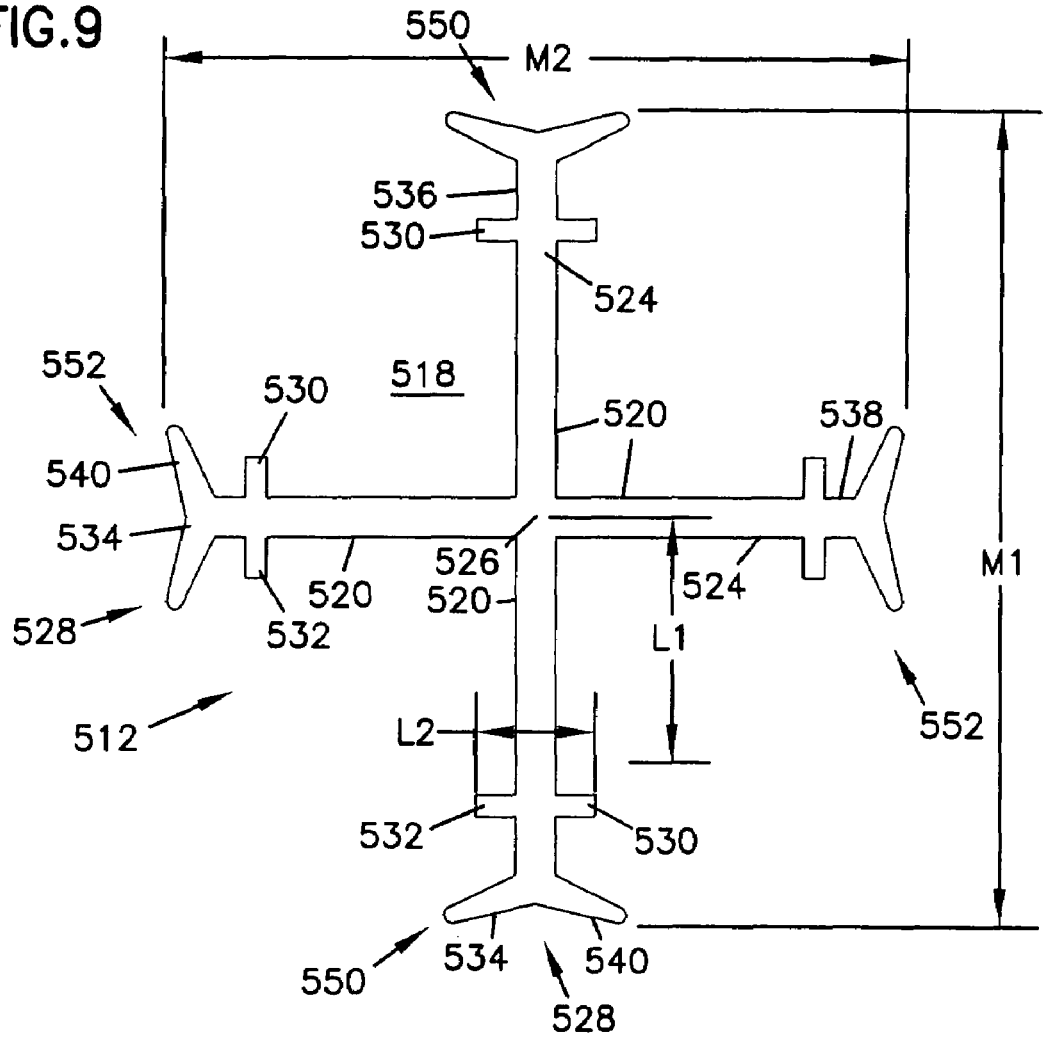
FIG. 9 is a cross-sectional view of a sixth embodiment of the shape of a filler for use in a multi-pair cable arrangement.

Referring now to FIG. 9, shaped elements 528 of a sixth filler 512 embodiment are illustrated. The shaped elements 528 include first shaped elements 550 and second shaped elements 552. The first shaped elements 550 are located at free ends 524 of radial extensions 520 that partially define a major dimension M1 of the filler 512. The second shaped elements 552 are located at free ends 524 of radial extensions 520 that partially define a minor dimension M2 of the filler 512.

Each of the first and second shaped elements 550, 552 shown in FIG. 9 includes a retaining member 530. The retaining members 530 are located at the free ends 524 of the respective radial extensions 520. The retaining members 530 are arranged and configured to retain the twisted conductor pairs 14 within pockets 518 of the filler 512. In particular, each of the retaining members 530 is oriented such that a major length L2 of the retaining member 530 is transverse to a length L1 of the respective radial extension 520. The major length L2 is provided so that adjacent end portions 532 of adjacent retaining members 530 contain or hold the twisted conductor pair 14 within the pocket 518 of the filler, as previously described with respect to the embodiment of FIG. 3.

Still referring to FIG. 9, the illustrated retaining members 530 of the shaped elements 528 have a rectangular shape. In the illustrated embodiment, the each of the first and second shaped elements 550, 552 of the filler 512 include an end piece 534 located adjacent to the rectangular retaining element 530.

The end pieces 534 are interconnected to the retaining elements 530 by necks 536, 538. Each of the necks 536 of the first shaped elements 550 is longer than the necks 538 of the second shaped elements 552. Accordingly, the necks 536 and the end pieces 534 of the first shaped elements 550 provide the major dimension M1 that is greater than the minor dimension M2 provided by the second shaped elements 552 of the filler. The end pieces 534 of the first shaped elements 550 project radially outward a distance farther from a center 526 of the filler 512 than the second shaped elements 552 to create helical ridges 60 (FIG. 1) in the jacket 16 of the multi-pair cable 10, as previously described.

In the illustrated embodiment of FIG. 9, the end pieces 534 of the first and second shaped elements 550, 552 are triangular in shape. The triangular end pieces are oriented such that the apex opposite a longest side 540 of the triangular end pieces 534 points toward the center 526 of the filler 512. In contrast to the previous embodiment, the longest side 540 of each of the triangular end pieces 534 of FIG. 9 is detented or formed with a concave curvature.

Similar to the previous embodiments, the shaped elements 550, 552 of the filler 512 are at least partially located outside a boundary (e.g., 70 in FIG. 4) of the twisted pairs core (e.g., 72); and, the outermost shaped element, e.g., the end piece 534 of the first shaped element 550, of the filler 512 defines a shaped-element boundary (e.g., 74) that is greater than the boundary of the twisted pairs core to radially space the twisted pairs core from the jacket 16 of the cable 10.

Figure 10:
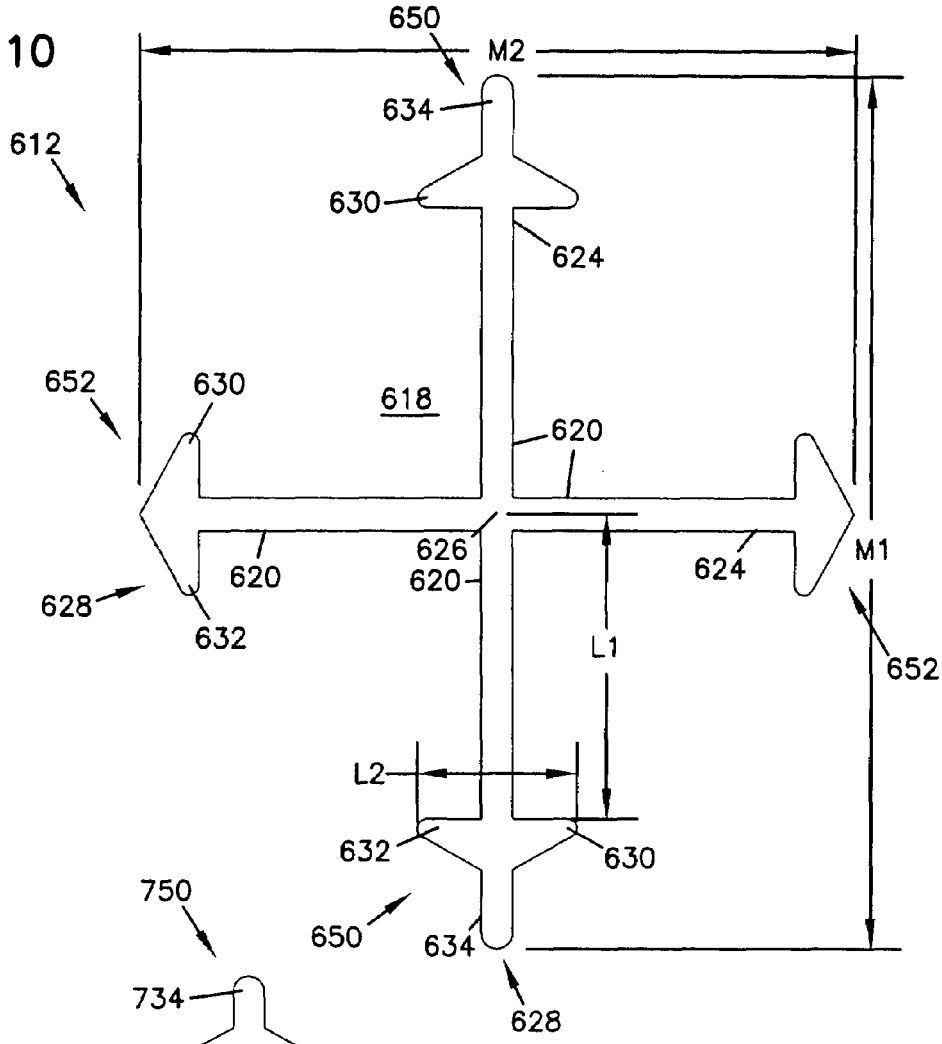
FIG. 10 is a cross-sectional view of a seventh embodiment of the shape of a filler for use in a multi-pair cable arrangement.

Referring now to FIG. 10, shaped elements 628 of a seventh filler 612 embodiment are illustrated. The shaped elements 628 include first shaped elements 650 and second shaped elements 652. The first shaped elements 650 are located at free ends 624 of radial extensions 620 that partially define a major dimension M1 of the filler 612. The second shaped elements 652 are located at free ends 624 of radial extensions 620 that partially define a minor dimension M2 of the filler 612.

Each of the first and second shaped elements 650, 652 shown in FIG. 10 includes a retaining member 630. The retaining members 630 are located at the free ends 624 of the respective radial extensions 620. The retaining members 630 are arranged and configured to retain the twisted conductor pairs 14 within pockets 618 of the filler 612. In particular, each of the retaining members 630 is oriented such that a major length L2 of the retaining member 630 is transverse to a length L1 of the respective radial extension 620. The major length L2 is provided so that adjacent end portions 632 of adjacent retaining members 630 contain or hold the twisted conductor pair 14 within the pocket 618 of the filler, as previously described with respect to the embodiment of FIG. 3.

Still referring to FIG. 10, the illustrated retaining members 630 of the shaped elements 628 have an arrowhead shape, i.e., a triangular shape. In the illustrated embodiment, the second shaped elements 652 of the filler 612 are simply the triangular retaining members 630 located at the free ends 624 of the extension 620. The first shaped elements 650 however further include an end piece 634 located adjacent to the triangular retaining element 630.

The end pieces 634 are located at a tip or apex of the triangular retaining members 630. The end pieces 634 of the first shaped elements 650 provide the major dimension M1 that is greater than the minor dimension M2 provided by the second shaped elements 652 of the filler. The end pieces 634 project radially outward a distance farther from a center 626 of the filler 612 than the second shaped elements 652 to create helical ridges 60 (FIG. 1) in the jacket 16 of the multi-pair cable 10, as previously described. In the illustrated embodiment of FIG. 6, the end pieces 634 of the first shaped elements 650 are formed as tip projections that extend outward from the apex of the triangular retaining members 630.

Similar to the previous embodiments, the shaped elements 650, 652 of the filler 612 are at least partially located outside a boundary (e.g., 70 in FIG. 4) of the twisted pairs core (e.g., 72); and, the outermost shaped element, e.g., the end piece 634 of the first shaped element 650, of the filler 612 defines a shaped-element boundary (e.g., 74) that is greater than the boundary of the twisted pairs core to radially space the twisted pairs core from the jacket 16 of the cable 10.

While each of the filler embodiment shown in FIGS. 3 and 5-10 provide a cable having an elliptical cross-section, it is contemplated some of the features presently disclosed can be employed in a filler that provides a cable having a generally circular cross-section. One such filler embodiment is shown in FIG. 11.

Figure 11:
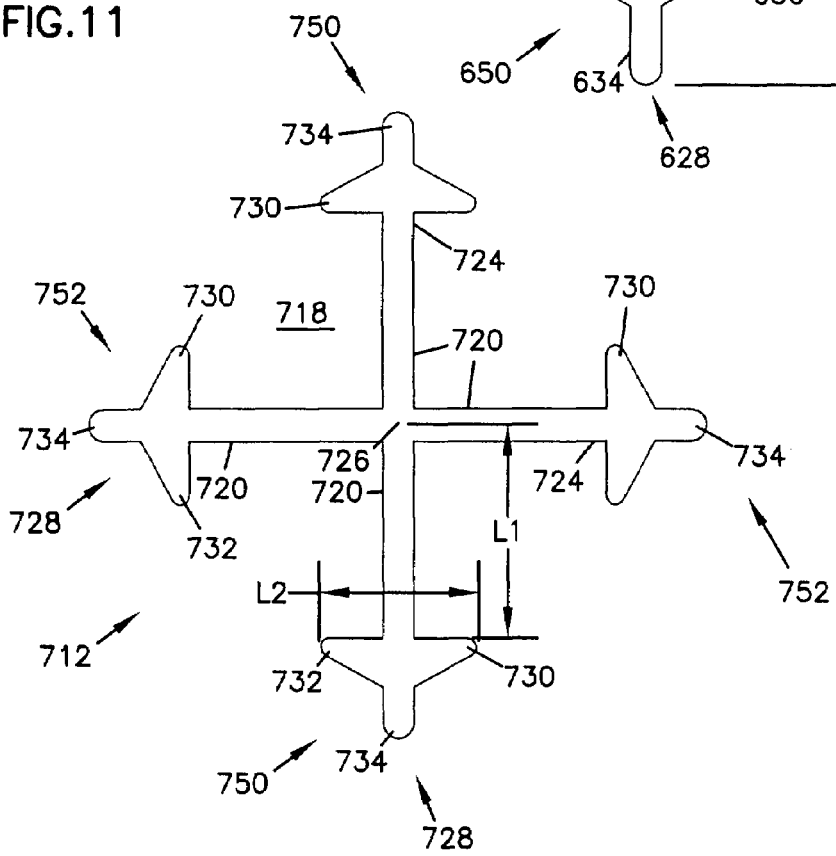
FIG. 11 is a cross-sectional view of an eighth embodiment of the shape of a filler for use in a multi-pair cable arrangement.

Referring to FIG. 11, an eighth embodiment a filler 712 is illustrated. The filler 712 has shaped elements 728, including first shaped elements 750 and second shaped elements 752. Each of the first and second shaped elements 750, 752 are located at free ends 724 of radial extensions 720. In contrast to the previous embodiments having major and minor dimensions that provide the elliptical shaped cable, the extensions 720 and the first and second shaped elements 750, 752 are generally equally distanced from a center 726 of the filler.

Similar to the previous embodiments, each of the first and second shaped elements 750, 752 shown in FIG. 11 includes a retaining member 730. The retaining members 730 are located at free ends 724 of the respective radial extensions 720. The retaining members 730 are arranged and configured to retain the twisted conductor pairs 14 within pockets 718 of the filler 712. In particular, each of the retaining members 730 is oriented such that a major length L2 of the retaining member 730 is transverse to a length L1 of the respective radial extension 720. The major length L2 is provided so that adjacent end portions 732 of adjacent retaining members 730 contain or hold the twisted conductor pair 14 within the pocket 718 of the filler, as previously described with respect to the embodiment of FIG. 3.

Still referring to FIG. 11, the illustrated retaining members 730 of the shaped elements 728 have an arrowhead shape, i.e., a triangular shape. In the illustrated embodiment, each of the first and second shaped elements 750, 752 further includes an end piece 734 located adjacent to the triangular retaining element 730.

The end pieces 734 are located at a tip or apex of the triangular retaining members 730. In general, the end pieces 734 are formed as tip projections that extend outward from the apex of the triangular retaining members 730. The retaining members 730 of the filler 712 are constructed to retain the twisted conductor pairs 14 at or adjacent to the center 726 of the filler 712. That is, the retaining members 730 retain the twisted conductor pairs 14 within a boundary (e.g., 70 represented by dashed line in FIG. 4). The boundary defines an outer diameter (e.g., D3) of a twisted pairs core (e.g. 72) that is defined by the twisted conductor pairs 14.

Preferably, the shaped elements 750, 752 of the filler 712 are at least partially located outside the boundary of the twisted pairs core. The end pieces 734 of both the first and second shaped elements 750 of the filler 212 define a shaped-element boundary (e.g., 74 in FIG. 4) that is greater than the boundary of the twisted pairs core to radially space the twisted pairs core from the jacket 16 of the cable 10.

Figure 12:
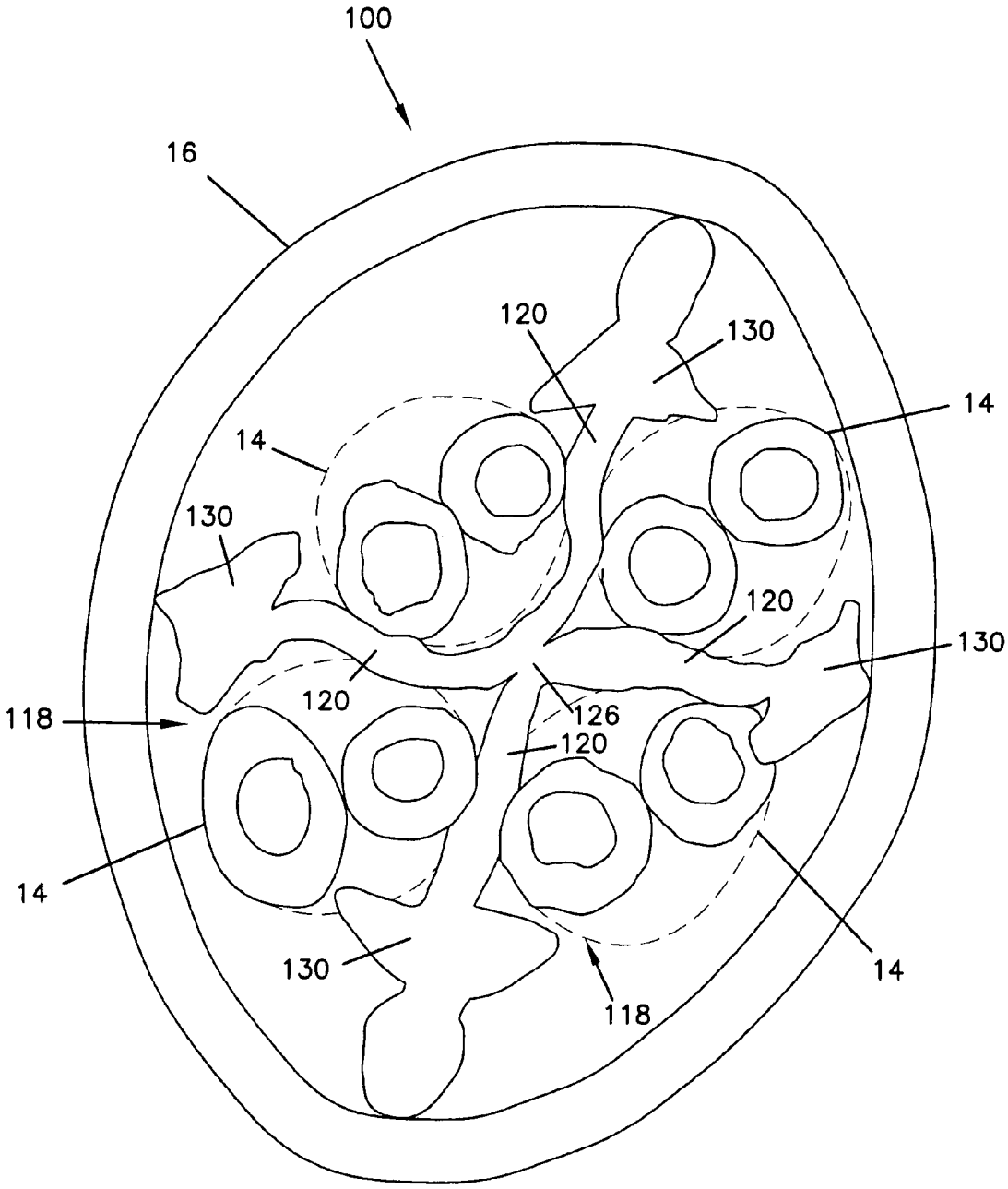
FIG. 12 is a cross-sectional view of a multi-pair cable embodiment including the filler of FIG. 4, and shown with twisted pairs.

Referring now to FIG. 12, a multi-pair cable embodiment 100 including the filler 112 of FIG. 5 is shown with twisted pairs 14. As shown, in some methods of manufacturing, during the application of the jacket 16, the filler (e.g., 112) becomes distorted or deformed. Similar deformation results can be achieved with the filler embodiments of FIGS. 3 and 6-11. Deformation of the filler 112, and in particular, the radial extensions 120 causes the retaining members 130 to contact the twisted conductor pairs to more securely retain the pairs 14 within the pockets 118. As can be understood, while in FIG. 12 one of the pockets appears to have an opening larger than the diameter of the pair, the cross-sectional view of FIG. 12 does not represent the deformation occurring along the length of the filler 112. That is, the filler 112 deforms such that portions of the filler along the filler length, as a whole bias the pairs 14 toward the center 126 of the filler 112.

The disclose filler (including each of the filler embodiments of FIGS. 3 and 5-11) provides a retentive filler arrangement that enhances the structural integrity of the twisted pairs core, while at the same time spacing the jacket 16 from the core 172 to enhance signal transmission performance. The above specification provides a complete description of the invention. Since many embodiments of the invention can be made without departing from the spirit and scope of the invention, certain aspects of the invention reside in the claims hereinafter appended.

What is claimed is:

1. A method of assembling a cable, comprising the steps of:

a) providing a flexible filler having a center and a plurality of legs that define pockets, the legs having a first end connected to the center and a second end opposite the first end, the second end of at least one leg of the plurality of legs being located a distance farther from the center than another lea;

b) providing a plurality of twisted pairs, each of the twisted pairs having a length;

c) zipping each twisted pair into a corresponding pocket of the filler, including pressing each twisted pair along the length of the twisted pair while deforming the filler so that the twisted pair zip-fits within the corresponding pocket, the zip-fit being provided by a zip-fit construction including a retaining element located adjacent to the second end of each leg; and d) applying a jacket over the filler and the twisted pairs zip-fit with the pockets of the filler;

e) wherein a ridge is formed in the jacket by the second end of the at least one leg.

2. The method of claim 1, wherein the twisted pairs are captured by the retaining elements without the retaining elements substantially surrounding the twisted pairs.

3. The method of claim 1, further including twisting the filler about a central filler axis after the twisted pairs are zip-fit within the pockets.

4. The method of claim 3, wherein the step of applying the jacket over the filler and the twisted pairs; is performed after the filler has been twisted.

5. The method of claim 4, wherein the ridge is a helical ridge formed in the jacket by the twisted filler.

6. The method of claim 1, further including deforming the filler while applying the jacket, wherein the twisted pairs are biased toward the center of the filler central filler axis by the deformation.

7. The method of claim 6, wherein the filler spaces the twisted pairs from the jacket.

8. The method of claim 1, wherein the step of providing the plurality of twisted pairs includes providing twisted pairs each having a twist rate that is different from that of the other twisted pairs.

9. The method of claim 8, further including changing the twist rate of each twisted pair by twisting the filler about a central filler axis.

10. The method of claim 8, wherein the step of providing twisted pairs includes providing twisted pairs each twisted in the same twist direction.

11. The method of claim 10, further including twisting the filler in the same twist direction as the twisted pairs, after the twisted pairs are zip-fit within the pockets, to increase the twist rate of each twisted pair.

12. A cable, including:

a) a plurality of twisted pairs;

b) a filler defining pockets, each twisted pair being positioned within one of the pockets, the filler including:

i) a plurality of spokes, each spoke including a first end and a second end, the first ends of the spokes being joined to define a filler center; and ii) shaped elements located at the second ends of the spokes, each of the shaped elements including a retaining member oriented in a generally transverse position relative to the corresponding spoke, the retaining members being arranged to retain the twisted pairs within the pockets of the filler, at least one of the shaped elements extending a distance farther from the filler center than the other shaped elements, the at least one shaped element including an end piece having a circular cross-section; and c) a jacket surrounding the filler and the plurality of twisted pairs.

13. The cable of claim 12, wherein the jacket has a helical ridge formed by the end piece of the filler.

14. The cable of claim 12, wherein the retaining members are constructed such that the twisted pairs are zip-fit within the pockets of the filler.

15. The cable of claim 12, wherein the retaining members have a triangular shape.

16. The cable of claim 12, wherein the filler has a major filler dimension and a minor filler dimension, the at least one shaped element including the end piece defining the major filler dimension.

17. The cable of claim 12, wherein the spokes define four pockets each sized to receive one twisted pair.

* * * * *